US005287711A

United States Patent [19]

Chang et al.

[11] Patent Number: 5,287,711

[45] Date of Patent: Feb. 22, 1994

[54] LABORATORY APPARATUS FOR DYEING TEXTILE FABRICS

[75] Inventors: Julie L. Chang, Newark, Del.; Darwin E. Ferster, Rising Sun; Robert E. Shamrock, Elkton, both of Md.

[73] Assignee: E. I. Du Pont de Nemours and Company, Wilmington, Del.

[21] Appl. No.: 905,353

[22] Filed: Jun. 24, 1992

[51] Int. Cl.[5] ..... D06B 5/22

[52] U.S. Cl. ..... 68/148; 68/157; 68/186

[58] Field of Search ..... 68/148, 157, 165, 170, 68/186, 187, 194

[56] References Cited

U.S. PATENT DOCUMENTS

| | | | |
|---|---|---|---|
| 1,873,004 | 8/1932 | Meinig | 68/170 X |
| 2,559,030 | 7/1951 | Rottier | 68/165 |
| 2,901,902 | 9/1959 | Horsfall | 68/170 |
| 3,379,038 | 4/1968 | Blancafort | 68/170 X |
| 3,534,569 | 10/1970 | Doell | 68/165 |
| 4,899,558 | 2/1990 | Suess et al. | 68/15 |

FOREIGN PATENT DOCUMENTS

| | | | |
|---|---|---|---|
| 140411 | 1/1961 | U.S.S.R. | 68/170 |

OTHER PUBLICATIONS

Brochure provided by Zeltex AG.

Brochure provided by Data Color AG.

*Primary Examiner*—Frankie L. Stinson

[57] ABSTRACT

Apparatus in accordance with the invention is of the type in which textile fabric samples are dyed in a generally cylindrical vessel containing a liquid dyeing bath while being moved in a cyclical fashion by a sample holder having a generally vertical rod connected to an overhead stirrer. The improved apparatus includes means connected to the generally vertical rod for holding the textile fabric sample in a generally cylindrical configuration, a pump for pumping a concentrated chemical solution at a controlled rate, and means for supplying the concentrated chemical solution from the pump under the surface of the dyeing bath in at least two vertically spaced-apart locations.

20 Claims, 2 Drawing Sheets

LABORATORY APPARATUS FOR DYEING TEXTILE FABRICS

BACKGROUND OF THE INVENTION

The present application relates to laboratory apparatus for the dyeing of textiles and more particularly relates to such apparatus for use where it is desired to introduce dye and/or chemicals into the bath in a controlled manner.

Dyers of textile fabrics routinely perform small scale dyeings to determine the commercial viability of processes using particular dyes or combinations of dyes with certain fabrics and for shade matching, e.g., determining the amount of dye needed to obtain a desired shade. Various laboratory apparatus are known for such small scale dyeings. One type of such apparatus uses a generally cylindrical vessel containing a liquid dyeing bath and a sample holder for moving the samples in the bath in a cyclical fashion such as with a twist and stroke motion. The sample holder typically includes a generally vertical rod connected to an overhead stirrer. Forks or a basket of wire or other perforated material mounted on the rod are typically provided to hold the sample so that it is carried with the sample holder.

Known apparatus of this type is effective in performing conventional dyeing processes where the dye and chemicals such as dyeing auxiliaries are present in the bath when the dyeing is begun. However, such apparatus has been found to be unsatisfactory for laboratory dyeings in which it is desired to add dye and/or chemicals in a controlled manner as the dyeing progresses. For example, with conventional apparatus, it is difficult to achieve a level dyeing of nylon fabrics if dye is added to a heated bath in a process such as that disclosed in PCT Publication No. WO92/08838, May 29, 1992.

SUMMARY OF THE INVENTION

Apparatus in accordance with the invention is of the type in which textile fabric samples are dyed in a generally cylindrical vessel containing a liquid dyeing bath. The samples are moved in a cyclical fashion by a sample holder having a generally vertical rod connected to an overhead stirrer. The improved apparatus includes means connected to the generally vertical rod for holding the textile fabric sample in a generally cylindrical configuration, a pump for pumping a concentrated chemical solution at a controlled rate, and means for supplying the concentrated chemical solution from the pump under the surface of the dyeing bath in at least two vertically spaced-apart locations.

In a preferred form of the invention, the textile fabric sample is held in a generally cylindrical configuration by two spaced-apart disks mounted on the rod in a generally parallel relationship. Each of the disks have a disk edge contacting the sample to define the cylindrical configuration. Means are provided for attaching the fabric sample to each of the disk edges. Preferably, the fabric samples are attached to the disk edges using an annular groove in each of the disk edges, and a resilient ring dimensioned to fit snugly into each of the annular grooves.

In accordance with a preferred form of the invention, the concentrated chemical solution is conveyed from the pump to the rod and an elongated axial bore is provided within the rod for receiving the chemical solution conveyed from the pump. At least two vertically spaced-apart outlet orifices from the bore to the outer surface of the rod are provided at positions under the surface of the dyeing bath.

The apparatus of the invention provides improved laboratory apparatus which can achieve level dyeings of nylon fabric samples using processes in which dye is added to a heated bath.

DETAILED DESCRIPTION

Figure 1:
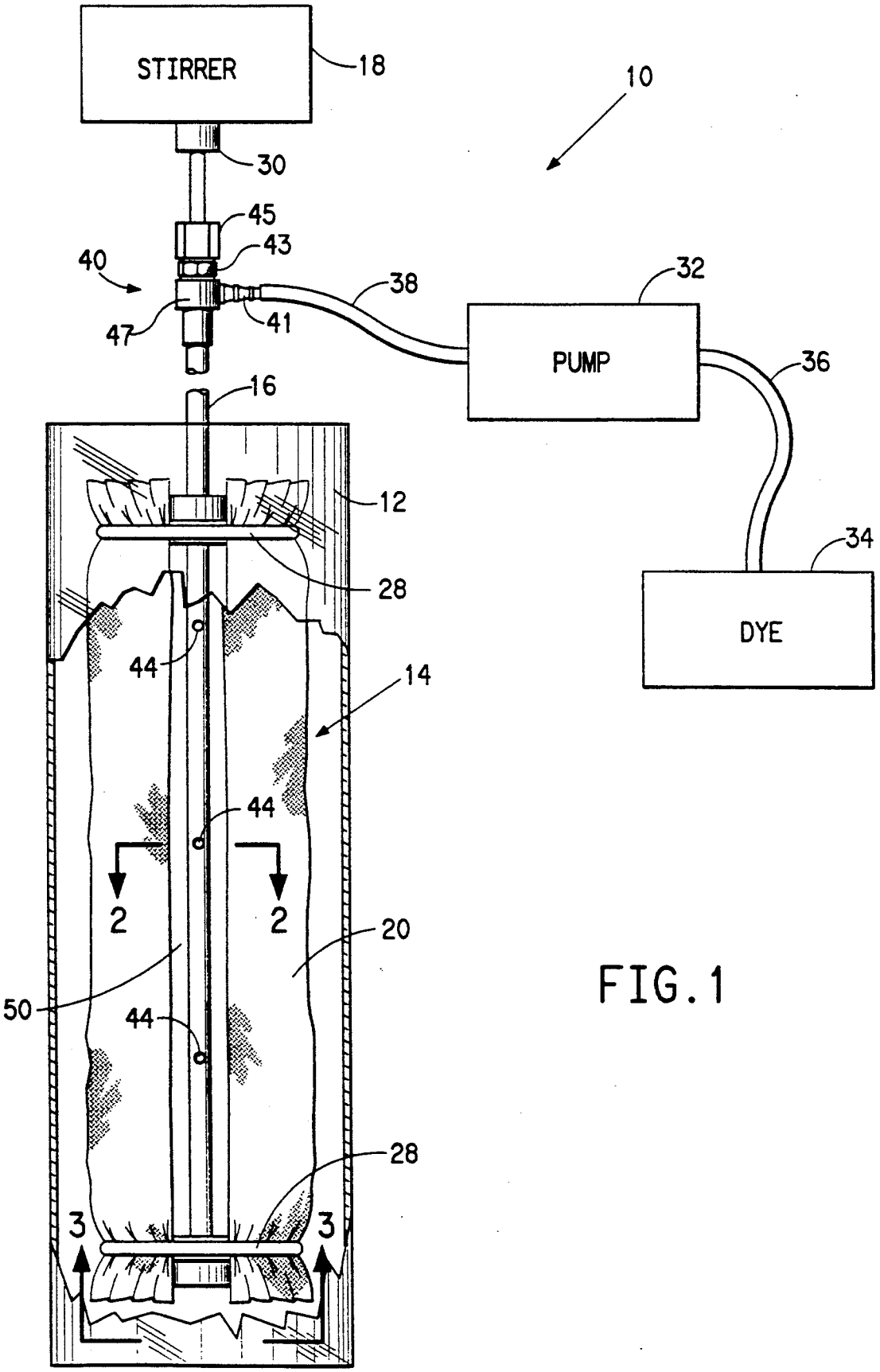
FIG. 1 is a partially broken-away elevational view of a preferred embodiment of apparatus in accordance with the present invention.

With reference to FIG. 1, preferred apparatus 10 for the laboratory dyeing of textile fabric samples in accordance with the invention is illustrated. The apparatus is of the type including a generally cylindrical vessel 12 for containing a liquid dyeing bath. The apparatus includes a sample holder 14 including a generally vertical rod 16 connected to an overhead stirrer 18. The overhead stirrer 18 moves the sample holder 14, and thus also the textile fabric sample 20, in a cyclical fashion. A typical cyclical motion is, for example, a stroke and twist motion although other motions are also possible. Equipment of this general type is available commercially from DataColor AG, Ahiba Laboratory Dyeing Systems, Brandbachstrasse 10, CH-8305 Dietlikon, Switzerland under the trademark AHIBA TEXOMAT and from Zeltex AG, Bahnhofstrasse 48, CH-4132 Muttenz/Basel, Switzerland under the trademark ZELTEX VISTACOLOR.

In accordance with the invention, the sample holder 14 holds a fabric sample 20 in a generally cylindrical configuration. As is seen by also referring to FIGS. 3 and 4, this is preferably accomplished by employing two spaced-apart disks 22 which are attached to the vertical rod 16 in a generally parallel relationship. Each of the disks 22 have a disk edge 24 which contact the sample 20 to define the cylindrical configuration.

Preferably, as shown in the embodiment illustrated, the sample 20 is attached to the disk edges 24 by the provision of an annular groove 26 in each of the disk edges 24. A resilient ring 28 is dimensioned to fit snugly into each of the annular grooves 26. In this manner, the fabric sample is held onto the sample holder with the sample being clamped between the resilient ring 28 and the disks 22.

Figure 3:
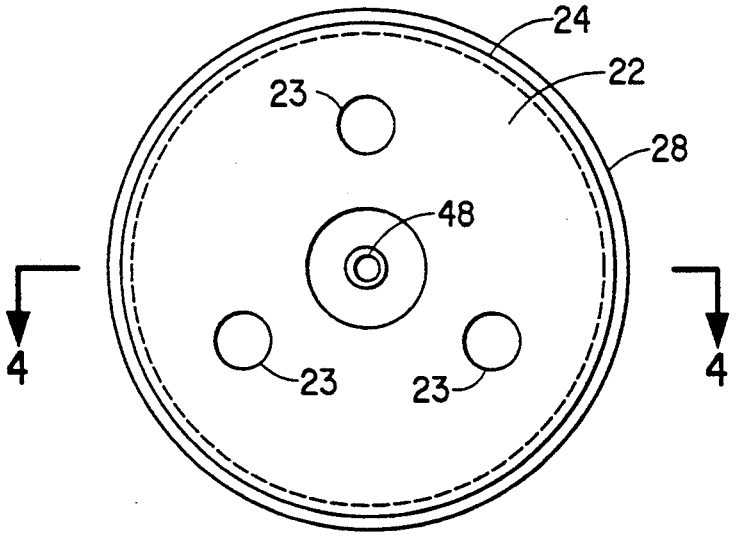
FIG. 3 is a plan view of a portion of the apparatus of FIG. 1 viewed as indicated by line 3—3 (fabric sample not shown)
Figure 4:
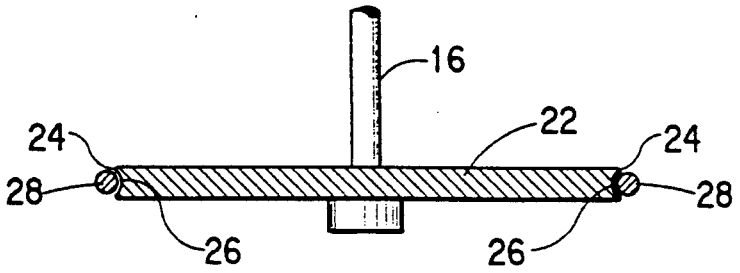
FIG. 4 is a cross-sectional view of a portion of the apparatus of FIG. 1 taken along line 4—4 of FIG. 3.

As shown in FIG. 3, holes 23 are preferably provided in the disks 22 to facilitate mixing in the bath liquid. For a disk 22 having a diameter of about 50 mm such as for use in a 60 mm diameter vessel, three holes 23 in an equilateral triangular arrangement about the rod and having a diameter of about 6.4 mm have been found to provide suitable mixing.

It is desirable for the disks 22 to have a diameter such that a suitable distance is provided between the fabric sample 20 and the wall of the vessel 16 to provide free motion of the sample holder and adequate circulation and mixing of the bath due to the motion of the sample holder 14. Preferably, the clearance when the disk is centered between the fabric sample 20 and the vessel is between about 2 mm and about 6 mm. This clearance is important to limit free flow of bath solution around the outer edge of the disks 22, so that more fluid will flow through holes 23 in the disks as the sample holder is moved vertically in the vessel. A typical clearance between the disk edge 24 and the vessel can be about 10 mm but an appropriate diameter disk should be used depending upon fabric thickness to appropriate adjust the clearance between the fabric and the vessel. When the clearance between the fabric and the vessel is between about 2 and about 6 mm, it has been found that flow through holes 23 acts to mix the dye thoroughly within the cylindrical space defined by the fabric.

Referring again to FIG. 1, the upper end of the vertical rod 16 should be adapted to accommodate a sample holder connector 30 of the overhead stirrer 18. For example, if the sample holder connector 30 is simply a receptacle with a set screw, the upper end of the rod 16 can simply be suitably dimensioned to be received within the receptacle and optionally may have a flattened area for more secure engagement with the set screw.

Referring again to FIG. 1 illustrating the preferred embodiment, the apparatus 10 in accordance with the invention includes a pump 32 connected to a source of dye 34 containing a liquid dye concentrate. The pump 32 is a pump which can supply the liquid dye concentrate at a controlled rate, i.e., a metering pump. The pump 32 should be of a suitable size to supply the dye at a desired controlled rate. A particularly suitable pump is a peristaltic pump in which the pumping rate is controllable and fixed by changing the diameter of a length of flexible tubing in the pump. The source of the dye 34 can be a suitable receptacle capable of holding the dye concentrate and the dye concentrate is carried to the pump by suitable means such as through hose 36.

While the preferred embodiment illustrated indicates that the chemical solution to be supplied is dye, it will be understood that the apparatus 10 can also supply any of a wide variety of chemicals useful in dyeing. For example, acids or bases can be metered into the bath to adjust the pH of the bath as the dyeing progresses. The solution may contain dye together with other chemicals such as dyeing auxiliaries, i.e., leveling agents, retarders, and the like. In addition, after the dyeing has been completed, the apparatus can be used to supply after-treatment chemicals such as antisoil agents, dye fixatives and the like. Accordingly, it will be understood that the term "concentrated chemical solution" as used herein refers a concentrated solution containing dye and/or chemicals.

The apparatus 10 in accordance with the invention receives dye concentrate from the pump 32 and supplies it under the surface of the dyeing bath in at least two vertically spaced-apart locations. Referring again to FIG. 1 and also to FIG. 2, this is preferably accomplished using hose 38 which is connected between the pump 32 and a chemical input fitting 40 on the vertical rod 16. Using this fitting 40, the portion of the vertical rod 16 above the fitting is a solid rod while below the fitting 40 the rod is provided with an elongated axial bore 42. Thus, this portion of the vertical rod 16 can be provided by a suitably dimensioned tube such as a stainless steel tube. The fitting 40 provides a mechanical connection to the upper portion of the vertical rod 16 and includes a hose connection 41 for connection to the hose so that the dye or other chemical supplied by the pump through the hose flows to the axial bore 42 of the lower portion of the rod 16.

Preferably, the chemical input fitting 40 provides for the adjustment of the rotational position of said hose connection 41. This is desirable in use so that the hose connection 42 is generally aligned with the position of the hose 38 since the hose must be able to supply dye or other chemical as the sample holder moves. This is particularly important when multiple vessels are used at the same time so that the hoses of adjacent vessels do not interfere with one another.

While rotational adjustment of the hose connection 41 can be provided by a rotary coupling that pivots continuously during use, it is most preferable for position of the hose connection 41 to be adjustable through a wide range of fixed positions. This can be accomplished by constructing the fitting 40 using an adapter 43, the upper portion of which being a tube compression fitting with nut 45 for connection to the upper portion of the rod such as a SWAGELOK (TM) male connector tube fitting provided by Crawford Fitting Company, Solon, Ohio. The lower portion of the adapter 43 is threadably attached to a straight barb fitting 47 which provides the hose connection 41 and is connected to the lower tubular portion of the rod 16 such as by welding. The nut 45 of the compression fitting can be loosened and re-tightened to adjust the rotational position of the hose connection 41 to any desired position. There should be enough slack in the hose 38 so it can travel with the cyclical motion of the sample holder without kinking.

Figure 2:
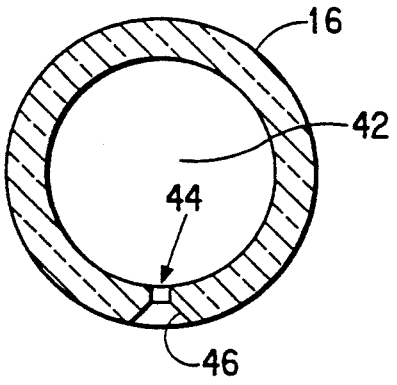
FIG. 2 is a cross-sectional view of the apparatus of FIG. 1 taken along line 2—2.

Referring still to FIGS. 1 and 2, at least two vertically spaced-apart outlet orifices from the axial bore 42 to the outer surface of the rod 16 are provided at positions such that they are under the surface of the dyeing bath when in use. As shown in FIG. 1, three outlet orifices 44 are provided in the embodiment illustrated. As may be seen in FIG. 2, the outlet orifices 44 are shaped to promote dilution of the concentrated dye solution into the dyeing bath. This is suitably accomplished by enlarging the orifices adjacent the outer surface of the rod 16 such as by forming a countersink 46 into the outer surface of the rod 16 at the orifice 44. Such a configuration also makes it easier to accurately machine the orifice 44. It is desirable for the disks 22 to have an outer diameter such that a suitable radial distance is provided between the inner surface of the fabric sample and the outlet orifices 44 which, in the embodiment of FIG. 1, essentially corresponds to the outer surface of rod 16. If the fabric is too close to the orifice, the dye may not be diluted enough before encountering the fabric, and the fabric will be dyed unevenly. It is also important that the fabric is taut between the disks 22 so it does not deflect during motion of the sample holder 14, and thereby decrease the distance between the fabric and the orifice. A preferred radial distance between the fabric 20 and the rod 16 is greater than about 15 mm.

As shown in FIG. 3, it is preferably for the lower end of axial bore 42 to have an opening 48 into the dyeing bath in the vessel 12. With the opening, the vertical motion of the sample holder 20 in the bath causes the bath liquid to enter the axial bore 42 and thus some mixing of the concentrated dye solution with the bath liquid is provided in the axial bore even before dye is pumped out of the outlet orifices 44.

In use, a fabric sample 20 is cut to the appropriate size to fit the sample holder 14. It is attached to the sample holder 14 at each disk 22 by means of the resilient ring 28 being fitted into the annular groove 26 on the disk 22 with fabric sample 20 between the ring 28 and the disk. As in the preferred embodiment in which dye is to be introduced into the bath using the apparatus, it is desirable as shown in FIG. 1 for the fabric sample to be of the appropriate size such that it forms a generally cylindrical configuration on the disks but with a gap 50 adjacent the outlet orifices 44. This aids in promoting mixing of the dye before contacting the fabric such that the dye is more uniformly applied to the fabric on both its inner and outer surfaces.

The sample holder 14 with the attached fabric sample 20 is attached to the overhead stirrer 18 at the sample holder connector 30. The vessel 12 is filled with the appropriate liquid such as water to provide the dyeing bath in the vessel. The stirrer can be activated to set the sample holder 14 and attached fabric sample in motion. Although not shown, commercial equipment of this type usually has capability to heat the vessel 12 by immersion of a portion of the vessel 16 in a larger vessel containing a heated liquid.

With the conditions in the dyeing bath being controlled as desired, the dye concentrate from the source is pumped by the pump into the axial bore 42 of the sample holder and thus it is distributed through the outlet orifices 44 into the bath.

We claim:

1. In laboratory apparatus for dyeing textiles, said apparatus being of the type in which textile fabric samples are dyed in a generally cylindrical vessel containing a liquid dyeing bath while being moved in a cyclical fashion by a sample holder having a generally vertical rod connected to an overhead stirrer, the improvement which comprises:

means connected to said generally vertical rod for holding the textile fabric sample in a generally cylindrical configuration;

an independent pump for pumping a concentrated chemical solution at a controlled rate; and means for supplying said concentrated chemical solution from said pump under the surface of said dyeing bath in at least two vertically spaced-apart locations.

2. The apparatus of claim 1 wherein said means for holding said textile fabric sample in a generally cylindrical configuration comprises:

two spaced-apart disks mounted on said rod in a generally parallel relationship, each of said disks having a disk edge contacting said sample to define said cylindrical configuration; and means for attaching said fabric sample to each of said disk edges.

3. The apparatus of claim 2 wherein said disks are dimensioned to provide a centered clearance of between about 2 mm and about 8 mm between said fabric sample and said vessel.

4. The apparatus of claim 3 wherein said disks are dimensioned to provide a radial distance greater than about 15 mm between said disk edge and said outlet orifices on said rod.

5. The apparatus of claim 3 wherein said disks comprise holes permitting the liquid of said bath to flow through said disks.

6. The apparatus of claim 1 wherein said means for attaching said fabric samples to said disk edges comprises:

an annular groove in each of said disk edges; and a resilient ring dimensioned to fit snugly into each of said annular grooves.

7. The apparatus of claim 1 wherein said means for supplying said concentrated dying solution from said pump comprises:

means for conveying said chemical solution from said pump to said rod;

a elongated axial bore within said rod for receiving said chemical solution conveyed from said pump; and at least two vertically spaced-apart outlet orifices from said bore to the outer surface of said rod at positions under the surface of said dyeing bath.

8. The apparatus of claim 7 wherein said outlet orifices are shaped to promote dilution of said concentrated chemical solution into said dyeing bath.

9. The apparatus of claim 8 wherein said outlet orifices are enlarged adjacent said outer surface of said rod.

10. The apparatus of claim 7 wherein said means for supplying said concentrated chemical solution from said pump further comprises an opening into said bore below said spaced-apart outlet orifices of sufficient size to allow liquid in said bath to enter said bore and mix with said chemical solution in said bore.

11. The apparatus of claim 7 wherein said means for conveying said chemical solution from said pump to said rod comprises a hose and a chemical input fitting with a hose connection at the side of said rod, said chemical input fitting providing fluid flow from said hose connection into said bore, and means for adjusting the rotational position of said hose connection.

12. An improved sample holder for use with laboratory apparatus for dyeing textiles of the type in which textile fabric samples are dyed in a generally cylindrical vessel containing a liquid dyeing bath while being moved in a cyclical fashion, said sample holder comprising a generally vertical rod for connection to an overhead stirrer, the improvement comprising:

two spaced-apart disks mounted on said rod in a generally parallel relationship, each of said disks having a disk edge contacting said fabric sample and holding said sample in a generally cylindrical configuration; and an annular groove in each of said disk edges; and a resilient ring dimensioned to fit snugly into each of said annular grooves.

13. The sample holder of claim 12 wherein said disks are dimensioned to provide a clearance when centered of between about 2 mm and about 6 mm between said fabric sample and said vessel.

14. The apparatus of claim 13 wherein said disks are dimensioned to provide a radial distance greater than about 15 mm between said disk edge and said outlet orifices on said rod.

15. The sample holder of claim 12 wherein said disks comprise holes permitting the liquid of said bath to flow through said disks.

16. The sample holder of claim 12 wherein said rod comprises a tube having an elongated axial bore capable of receiving a concentrated chemical solution and at least two vertically spaced-apart outlet orifices extending from said bore to the outer surface of said tube at positions under the surface of said dyeing bath.

17. The sample holder of claim 16 wherein said outlet orifices are shaped to promote dilution of said concentrated chemical solution into said dyeing bath.

18. The sample holder of claim 17 wherein said outlet orifices are enlarged adjacent said outer surface of said tube.

19. The sample holder of claim 17 further comprising an opening into said bore below said spaced-apart outlet orifices of sufficient size to allow liquid in said bath to enter said bore and mix with said concentrated chemical solution in said bore.

20. The apparatus of claim 16 wherein said means said rod comprises a chemical input fitting with a hose connection at side of said rod and providing for fluid flow from said hose connection into said bore, and means for adjusting the rotational position of said hose connection.

* * * * *